US005736963A

United States Patent [19]

Roederer et al.

[11] Patent Number: 5,736,963

[45] Date of Patent: Apr. 7, 1998

[54] FEED DEVICE FOR A MULTISOURCE AND MULTIBEAM ANTENNA

[75] Inventors: Antoine Roederer, Noordwijk, Netherlands; Simon John Stirland, Hitchin, Great Britain

[73] Assignee: Agence Spatiale Europeenne, Paris, France

[21] Appl. No.: 616,487

[22] Filed: Mar. 19, 1996

[30] Foreign Application Priority Data

Mar. 20, 1995 [FR] France ..... 95 03202

[51] Int. Cl.[6] ..... H01Q 3/22

[52] U.S. Cl. ..... 342/373

[58] Field of Search ..... 342/373, 371, 342/372, 368

[56] References Cited

U.S. PATENT DOCUMENTS

| | | | |
|---|---|---|---|
| 5,115,248 | 5/1992 | Roederer | 342/373 |
| 5,151,706 | 9/1992 | Roederer et al. | 342/372 |
| 5,548,295 | 8/1996 | Lo Forti et al. | 342/373 |

FOREIGN PATENT DOCUMENTS

| | | |
|---|---|---|
| 313057 | 4/1989 | European Pat. Off. . |
| 420739 | 4/1991 | European Pat. Off. . |
| 497652 | 8/1992 | European Pat. Off. . |

*Primary Examiner*—Gregory C. Issing
*Attorney, Agent, or Firm*—Bell Seltzer Intellectual Property Law Group of Alston & Bird LLP

[57] ABSTRACT

The invention relates to a feed device for a multisource semiactive antenna with multiple beams, including:

a) a nonorthogonal beam shaper device (65) splitting Nb beam input signals and combining them to form Na output signals, b) Na amplifier modules (64), c) an orthogonal output power splitter (63) arranged between the Na amplifier modules (64) and Ne radiating elements (61).

According to the invention, Nb≦Na≦Ne, and the orthogonal transfer function of the splitter (63) permits change between, on the one hand, Nb distributions at the input of the splitter (63), in which the amplitude of the Na signals is equal for each of the Nb beams, and in which the phase satisfied the condition of equality of the scalar products, taken in pairs, of the Nb excitation vectors at the input of the splitter (63), and of the scalar products, taken in pairs, of the Nb corresponding output excitation vectors and, on the other hand, Nb predetermined output distributions.

Appended FIG. 6.

28 Claims, 9 Drawing Sheets

FEED DEVICE FOR A MULTISOURCE AND MULTIBEAM ANTENNA

BACKGROUND OF THE INVENTION

The subject of the present invention is a device intended for feeding multisource antennas for the generation of multiple beams, in particular with partial or total overlap.

With such antennas, some angular regions are covered by more than one beam. Each beam has prescribed shape and contours for optimizing the gain as a function of direction, and thus, in many cases, for limiting interference.

Nb multiple beams with partial or total angular overlap can be generated by using antennas with Ne sources or radiating elements, either with direct radiation or indirect radiation, that is to say illuminating an optical system with one or more reflectors and/or lenses.

An optimum complex excitation law for these sources corresponds to each beam. When the beams have mutual angular overlaps, these optimum-directionality excitation laws are not generally "orthogonal".

By definition, two complex distributions $a_1, a_2, a_3 \ldots a_{Ne}$ and $b_1, b_2, b_3 \ldots b_{Ne}$ are orthogonal if their complex scalar products:

$p=\Sigma a_i \times b_i^*$ are zero for any i between 1 and Ne, $^*$ indicating the complex conjugate.

The beams corresponding to nonorthogonal distributions are also not orthogonal (see, for example "A Variable Power Dual Mode Network . . . " by H. S. Luh, IEEE Transactions—Volume AP 32 No. 12—December 1984—pages 1382–4). Their generation is consequently accompanied by losses in the beam shaping circuits.

Four possibilities currently exist:

The first possibility I is to accept these losses. By way of illustration, FIG. 1*a* shows an array antenna of this type with Ne=8 radiating elements 11 and with Nb=4 beams 10, using a so-called nonorthogonal Blass matrix 13. This type of splitter is described, for example, in the work "Microwave Antenna Handbook" by Y. T. Lo and S. W. Lee, 1988 edition, pps 19.10 and 19.11. On transmission, a portion of the power of one or more nonorthogonal beams is lost in the loads whose presence is necessary for the production of the desired nonorthogonal distributions.

The device in FIG. 1*a*, shown represented in transmission, normally operates with one amplifier per beam, which limits the flexibility in the power distribution between beams.

Such flexibility can be obtained (see FIG. 1*b*) by adding to the device in FIG. 1*a* a so-called multiport amplifier device including an identical number of amplifiers, equal in number to that of the beams, which are arranged between two hybrid splitters, for example consisting of Butler matrices (described in the cited work "Microwave Antenna Handbook" by Y. T. Lo and S. W. Lee, 1988). It will be recalled that a Butler matrix is a theoretically lossless passive network having N inputs and N outputs, N being generally a power of 2. Its inputs are isolated from one another, and a signal applied to any one of the inputs produces, on all the outputs, signals which have the same amplitude but the phases of which vary linearly from one output to the next.

The resulting assembly has a complex structure and, although it produces the desired beams, it involves electrical losses alter amplification which reduce the efficiency performance.

The second possibility II is to generate "orthogonal" excitation laws corresponding to a splitter without electrical losses.

According to known techniques, these distributions can only be approximated to the desired nonorthogonal ones, which results in a degradation in the directionality of the radiation compared to the optimum case and/or in the level of the secondary lobes.

This is the case of shaped-beam antennas, having a reflector illuminated by an array of radiating elements, themselves fed by a lossless multimode-type splitter illustrated by FIGS. 2*a* and 2*b*. The distribution laws on the array of sources and corresponding to the beams are obtained by optimization on the basis of the desired radiation diagrams. However, in order to obtain a lossless splitter, the orthogonality condition of the distributions must be added into the optimization, which leads, according to known techniques, to a reduction in directionality. Such antennas, employing a splitter network whose output signals are controlled only by the value of the phase of its phase-shifter elements, are described, for example, in the cited article "A Variable Power Dual Mode Network . . ." by H. S. Luh, IEEE Transactions AP 32 No. 12—December 1994—pages 1382–1384.

The devices in FIG. 2*a* and FIG. 3*a*, represented in transmission, respectively with Blass-type lossless matrices and cascade matrices, normally operate with one amplifier per beam, which limits the flexibility in the power distribution between beams. It will be noted that a cascade matrix is described in the article "On Multimode Antenna Concepts" by La Flame et al.,—ESA Workshop on Advanced Beam Networks—ESA WPP-030 (1991) (FIGS. 3 and 4).

Identical performances are obtained by so-called "diagonalization" matrices (see G. Ruggerini, "The diagonalisation BFN . . . ", Proceedings ICAP 1973, pages 570–573).

Such flexibility can be obtained by adding, to the devices in FIGS. 2*a* and 3*a*, a so-called multiport amplifier device including an identical number of amplifiers, equal to that of the beams, between two Butler matrix-type hybrid splitters (described in the cited work by Lo and Lee page 19.9).

The resulting devices, represented in FIGS. 2*b* and 3*b*, are complex and, although they do not involve losses after amplification, produce only approximate distributions giving beams with nonoptimal performances.

The third possibility III is to use an active antenna.

In an active antenna, one amplifier module is connected to each radiating element.

This type of antenna may include a direct-radiation array, as represented in FIG. 4 in transmission, or be an antenna with reflector illuminated by an array of the same type.

The distribution losses corresponding to the nonorthogonality of the optimum laws are here compensated for by distributed amplification, introduced between the lossy circuits and the radiating sources.

On transmission, the problem here is that the desired optimum distribution laws are not generally uniform, particularly if level control of the side lobes is required. This nonuniformity leads to different output levels for the power amplifiers, with the consequence of a nonmaximum efficiency (radiofrequency power/DC feed power) and very high consumption.

Optimizing only the phases, in order to avoid this problem, does not make it possible to obtain the desired distributions and degrades performance, in particular the side lobe control.

On reception, the problem is the requisite high number of low-noise amplifiers (one per radiating element instead of one per beam).

The fourth possibility IV is to use a so-called multimatrix semiactive antenna.

A semiactive antenna is an antenna with distributed (not centralized) amplification, in which a lossless hybrid splitter is introduced between the amplifier modules and the radiating elements in order to control the power distribution therein.

A multimatrix semiactive antenna is a semiactive antenna in which this lossless hybrid splitter consists of a multiplicity of smaller hybrid splitters with 2×2, 3×3, 4×4, 6×6, 8×8 . . . ports, which may or may not be identical, connected to the radiating elements in a manner which depends on the type of beam to be generated. In addition, the beams may be modified therein, if necessary, by acting on the low-level phase shifters. Such a multimatrix feed device is described, for multisource reflector antennas, in French Patent No. 89 12584, filed by the Applicant Company on 26 Sep. 1989 and published on 29 Mar. 1991 under U.S. Pat. No. 2,652,452, the inventor of which is A. Roederer, and for direct-radiation arrays, in French Patent No. 91 01086, filed by the Applicant Company on 31 Jan. 1991 and published on 7 Aug. 1992 under U.S. Pat. No. 2,672,436, the inventors of which are A. Roederer and C. van't Klooster. It makes it possible by optimization, for each beam, of the signal phases before amplification, to obtain beams close to those required. Such a system makes it possible to generate nonorthogonal distributions (beams) without losses. However, because only the phases at input are optimized, and the splitter is simplified by using small multiple splitters, the optimum distributions can only be approximated. This results in a directionality loss, typically between 0.5 and 1 decibel.

In practice:

The first solution I is rarely used because of the electrical losses.

The second solution II is the one most commonly used, often with only two beams (or modes) and with a separate amplification system for each multiplexed channel on each beam (FIG. 1*a*), but also sometimes in association with a multiport amplifier, for example for the US/Canada M-SAT satellites (see "M-SAT L-Band Antenna Subsystem", by S. Gupta, proceedings of the JINA'94 Symposium, page 197). The beam shaping matrices are orthogonal and this results in a directionality loss, typically between 0.5 and 1.5 dB compared to the ideal case, in which each beam would be generated from a separate antenna with the optimum law for the corresponding beam (ideal case).

The solution III, that is to say an active antenna, is successfully used for radars, where it is the product of the transmission/reception diagrams (beams), and not each of these diagrams, which is important. In this case, while keeping the amplitudes on transmission uniform, the phases on transmission and on reception and the amplitudes on reception are available for optimization.

Solution IV, that is to say a multimatrix semiactive antenna, may prove to have better performance than the preceding one, but, as has been indicated above, it does not, however, lead to the desired optimum distributions (except for the exceptional case in which these can be produced exactly by such a configuration).

SUMMARY OF THE INVENTION

The subject of the present invention is a feed device for a multisource antenna with multiple beams, which makes it possible to eliminate the directionality losses mentioned above, while avoiding losses in the high-level circuits.

A first object of the invention is thus to produce, exactly and without losses, and with a distributed and uniform amplification, the prescribed nonorthogonal excitation distributions with a semiactive antenna, either with direct radiation or with indirect radiation.

A second object of the invention is to make it possible to select a number Na of amplifiers which is different from the number Nb of beams and/or from the number Ne of radiating elements (or sources), whereas in the semi-active antennas of the prior art, the number Na of amplifiers is necessarily equal to the number Ne of radiating elements.

A third object of the invention is to make it possible to adjust the radiofrequency power distribution between beams, as a function of traffic fluctuations, or propagation conditions, while maintaining a minimum total power consumption.

The first object, as well as possibly the second and/or third objects of the invention, are obtained by a feed device for a multisource semiactive antenna with multiple beams, of the type successively including:

a) a low-level beam shaper device splitting Nb beam input signals as a function of desired coverage characteristics and combining them, after phase shifting, to form Na output signals on its Na outputs, said beam shaper device having a nonorthogonal transfer matrix, b) Na amplifier modules amplifying, in transmission mode, the Na output signals, c) an output power splitter arranged between the Na amplifier modules and Ne radiating elements, and having an orthogonal transfer matrix wherein $Nb \leqq Na \leqq Ne$, and wherein the orthogonal transfer matrix of the power splitter is such that it permits change between, on the one hand, Nb distributions at the input of the power splitter, in which the amplitude of the Na signals is substantially equal for each of the Nb beams, and in which the phase of the Na signals satisfied at least the condition of equality of the complex scalar products, taken in pairs, of the Nb excitation vectors at the input of the power splitter, and of the complex scalar products, taken in pairs, of the Nb corresponding output excitation vectors and, on the other hand, Nb predetermined output distributions.

The device according to the invention thus makes it possible to optimize both the phases and the amplitudes of the distributions, and therefore to avoid the directionality losses linked with the approximate distributions of the prior art.

In a manner which is known per se, at the input of the power splitter, the phases of the signals corresponding to one of the Nb distributions may be zero.

The splitter may include at least one directional module comprising a directional coupler with two inputs and two outputs and having a given directionality ratio r, and one associated phase-shifter element coupled to one output of the directional coupler.

In the absence of particular conditions for the beams (symmetry, etc.), the output power splitter with Na inputs and Ne outputs generally includes [(Ne-1)+(Ne-2) +. . . + (Ne-Na)] directional modules.

The invention applies particularly to the case when the number Na of amplifier modules is equal to the number Nb of beams.

In the device, according to a first variant, Nb=Na=Ne=2, and the power splitter includes one directional module, comprising one said directional coupler, having a directionality ratio r, the inputs of which are coupled to the outputs of the amplifier modules, and a phase-shifter element arranged between the directional coupler and one of the two radiating elements, the other output of the directional coupler being directly connected to the other radiating element.

In the device, according to a second variant, Nb=Na=2, and $Ne \geqq 4$, and the power splitter includes at least five directional modules, each of which includes a directional coupler, having a given directionality ratio r, the inputs of which constitute the inputs of the directional module and which has at a first output a phase-shifter element which is associated with it. It may preferably include five modules, and it then includes five directional modules, namely a first directional module having one input connected to the output of a first amplifier module and having its first and second outputs connected to one input, respectively, of a second and of a third directional module, the third directional module also having a second input connected to the output of a second amplifier module, the first and second outputs of the second directional module being connected to a first input, respectively, of a fourth directional module and of a fifth directional module, the first and second outputs of the third directional module being connected to a second input, respectively, of the fifth and of the fourth directional modules, and the outputs of the fourth and fifth directional modules each being connected to one radiating element.

The directionality ratio r of the first directional coupler of the first directional module and the phase shift of the phase-shifter element which is associated with it are such that, in reception mode, the power at the two input ports of the first directional module is the same for each of the two beams, and the directionality ratio r of the directional couplers of the fourth and fifth directional modules, and the phase shifts of their associated phase-shifter elements are such that the power corresponding to the first beam is concentrated in the reception mode toward a single one of their input ports, and the ratio r of the phase-shifter element of the third directional module and the phase shift of the associated phase-shifter element are such that the power corresponding to the first beam is concentrated toward its second input, and the directionality ratio r of the directional coupler of the first and second directional modules and the phase shifts of their associated phase-shifter elements are such that the output power of the second beam is concentrated, in the reception mode, toward a single one of their input ports.

In the device, according to a third particularly advantageous variant, Nb=Na=2, and Ne=8, and the directional splitter includes nine directional modules, each of which has a directional coupler, having a given directionality ratio r, the inputs of which constitute the inputs of the directional module, and having at a first output a phase-shifter element which is associated with it, the output of the associated phase-shifter element constituting the first output of the directional module, a first, second, third and fourth output directional module, having their outputs each connected to one radiating element, an input directional module having its inputs connected to the outputs of amplifier modules, and a first, second, third and fourth intermediate directional module, which are arranged in cascade, the first intermediate directional module having one input coupled to the second output of the input directional module, its first and its second outputs being coupled respectively to one input of the fourth output directional module and to one input of the second intermediate directional module, the second intermediate module having one input coupled to the first output of the input directional module and having its first and its second outputs coupled respectively to one input of the fourth output directional module and to one input of the third intermediate directional module, the third intermediate directional module having its first and second outputs coupled respectively to one input of the fourth intermediate directional module and to one input of the third output directional module, and the fourth intermediate directional module having its first and second outputs coupled respectively to one input of the second and of the first output directional modules. According to a preferred embodiment of this variant, the ratios r of the output couplers and of the second, third and fourth intermediate directional modules, as well as the phase shifts of the phase-shifter elements which are associated with them, are chosen so as to concentrate the power corresponding to a directional beam toward a single one of their input ports, while the ratio r of the directional coupler of the first intermediate directional module, and the phase shift of the phase-shifter element which is associated with it, are such that they concentrate the power corresponding to a nondirectional beam toward a single one of their input ports, and the ratio r of the directional coupler of the input phase-shifter module, and the phase shift of the phase-shifter element which is associated with it, are such that the powers are the same for the two beams at the inputs of the input phase-shifter module, and therefore on the outputs of the amplifier modules.

One possibility for the device, according to a variant corresponding to the case when Nb<Na, is that Nb=2, Na=4 and Ne=4, and that it includes a first and a second upstream directional module, the inputs of which are each connected to one output of an amplifier module, as well as a first and a second downstream directional module, the outputs of which are connected to the radiating elements, and the first and the second outputs of the first upstream directional module are connected respectively to one input of the first and of the second downstream directional modules, and the first and the second outputs of the second upstream directional module are connected respectively to one input of the second and of the first downstream directional modules. It is then possible that the ratio r and the phase shift of the first and of the second downstream directional modules are such that, in reception mode, the amplitudes of the signals on each of their inputs are equal, for each of the two incident beams, and the ratio r and the phase shift of the first and of the second upstream directional modules are such that, in reception mode, the amplitudes of the signals on their inputs are equal, for each of the two incident beams.

The invention also relates to a power splitter which is preferably usable in the context of the above feed device. This power splitter includes a plurality of directional modules which include a directional coupler having two inputs and two outputs and having, in the case of a directional module of a first type, one phase-shifter element arranged at a single one of the two outputs of said directional coupler, the output of the phase-shifter constituting the output of the module, and, in the case of a directional module of a second type, one phase-shifter element arranged at each of the two outputs of the directional coupler, the outputs of the phase-shifters constituting the outputs of the module.

It includes a symmetrical cascade arrangement without crossover, comprising a central line which includes at least one directional module of the second type, this central line being symmetrically surrounded by at least one left line and by at least one right line of directional modules of the first type, which are arranged in cascade without crossover, at least two directional modules of the first type constituting input modules having at least one input constituting the Na inputs of the power splitter, and it has directional modules of the first type constituting output modules and having at least one output connected to one input of the Ne antenna elements.

Advantageously, the directional modules of the first type which are arranged on one single side, respectively left or right relative to said central line, have their phase-shifter element arranged in the left or right output, respectively, of their directional coupler.

Advantageously, the directional modules of the first type which are neither input modules nor output modules, and which are situated on the left side relative to said central line have at least their right input connected to the left output of an upstream directional module, and vice versa symmetrically for said modules situated on the right side.

Advantageously, the directional modules of the first type which are neither input modules nor output modules, and which are situated on an extreme left line relative to said central line, have their left input connected to the left output of an upstream directional module, and their right input connected to the left output of another upstream directional module, and vice versa symmetrically for said modules situated on the right side.

At least one phase-shifter element may be variable, so as to allow at least partial reconfiguration of the beams.

The output power splitter may advantageously include a plurality of phase-shifter modules, including at least one input module, the inputs of which are connected to the outputs of the amplifier modules, and the directionality of the input module or modules is such that, for each beam, the powers on each of the inputs of the input phase-shifter module or modules are the same, while the other phase-shifter module or modules do not respect this condition.

The beam shaper device may operate at a frequency which is intermediate relative to the transmission/reception frequency of the device, and it then includes a frequency converter at each of its Na outputs, so as to permit a suitable frequency change.

The beam shaper device may, as a variant, operate at the transmission/reception frequency of the device.

The beam shaper device may be a digital circuit including digital/analog converters at output.

Said equality between the amplitudes of the Na signals for each of the Nb beams may be produced exactly or else by tolerating a slight ripple, of the order of ±1 dB, between the Ne signals, which does not in fine degrade the directionality performance.

The invention also relates to an antenna which includes a focusing device comprising at least one reflector and/or at least one lens, and a feed device as defined above, the Ne radiating elements which are associated with it being positioned relative to the focusing device so as to obtain focusing on transmission and/or on reception.

Finally, the invention relates to a method for determining the transfer function of the output power splitter of a feed device for a multisource semiactive antenna with multiple beams, of the type successively including:

a) a low-level beam shaper device splitting Nb beam input signals as a function of desired coverage characteristics and combining them, to form Na output signals on its Na outputs, said beam shaper device having a nonorthogonal transfer matrix, b) Na amplifier modules, amplifying, in transmission mode, the Na output signals, c) said output power splitter, which is arranged between the Na amplifier modules and Ne radiating elements, and having an orthogonal transfer matrix, wherein it includes the following steps, with $Nb \leqq Na \leqq Ne$:

setting the Na amplitudes of the distributions at the input of said power splitter to be equal for each of the Nb beams;

deducing therefrom Nb(Nb-1) equalities of the complex scalar products, taken in pairs, of the Nb complex excitation vectors at the input of the splitter and of the Nb output excitation vectors;

determining, directly or by an optimization program, the phases of the input signals;

deducing therefrom the transfer function of the splitter.

The power splitter may advantageously include [(Ne-1)+(Ne-2)+. . . (Ne-Na)] directional modules.

Other features and advantages of the invention will emerge more clearly on reading the following description, given by way of nonlimiting example and in conjunction with the appended drawings, in which:

DETAILED DESCRIPTION OF THE PREFERRED EMBODIMENTS

The device according to the invention is intended for feeding multibeam antennas with multiple radiating elements, of which the prescribed beams partially overlap and of which the corresponding excitation distributions of these elements are consequently not orthogonal, that is to say that their complex scalar products are nonzero.

The devices according to the invention can be used in transmission and/or in reception.

The antenna will essentially be described in transmission mode, but all the teachings may be transposed therefrom, mutatis mutandis, to operation in reception by simple application of the reciprocity principle, with the structure of the circuits and their connections remaining the same, but with the signal propagating from the antenna array to the transmission/reception circuits, instead of propagating in the opposite direction. Of course, in this case, the amplifier stages, which are placed at the same locations, are low-noise amplifier stages, the input of which lies on the antenna side and the output of which lies on the transmission/reception circuit side. The two types of amplifiers (power amplifiers for transmission and low-noise amplifiers for reception) may also coexist in the same module, with suitable switching or duplexing being employed.

By convention, and for the purpose of simplicity, the "inputs" and the "outputs" of each circuit (or stage, or module) will be defined by hypothetically assuming that the antenna is in transmission mode. In other words, the "inputs" and the "outputs" of each circuit (stage, or module), as defined above, will in reality fulfil the functions of outputs and inputs, respectively, in the case when the antenna would actually be in reception mode.

The device according to the invention includes a microwave hybrid splitter, the structure of which is fundamentally different from that of the usual devices. This design makes it possible, in particular and in contrast to existing devices, to select at will the number Na of amplifiers, which may be different than the number Nb of beams and/or the number Ne of radiating elements. The device of the invention is, in its general case, illustrated by FIG. 6.

Figure 7:
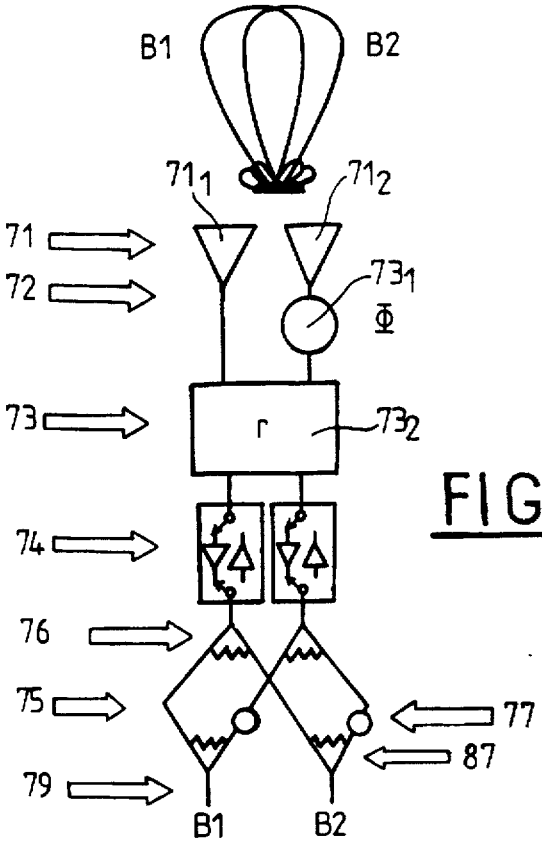
FIG. 7 represents one embodiment of the invention, in the case when Ne=Na=Nb=2.

Ne radiating elements 61, with direct radiation or illuminating an optical system 1, are connected by lines 62 to a lossless microwave hybrid splitter 63 with Ne×Na ports (Ne output ports and Na input ports). The Na input ports are connected to the outputs of Na amplifier modules 64. The inputs of the amplifiers 64 are connected to a lossy phase-shifter splitter 65 having Na×Nb ports. This phase-shifter splitter 65, which constitutes a low-level beam shaper device, includes Na combiners 66, each with 1×Nb ports (1 output port and Nb input ports), Na×Nb phase shifters or line sections 67, and Nb dividers 68, arranged between the ports 69 of the Nb beams and the phase shifters 67 for each beam. Each divider 68 has Na×1 ports. The device can operate in transmission, in reception or in both modes at once, by adapting the amplifier modules 64 to each case. FIG. 7 illustrates the simplest possible embodiment of the device of the invention, with Ne=Na=Nb=2. The amplifier modules are here of the transmission/reception type.

Figure 8:
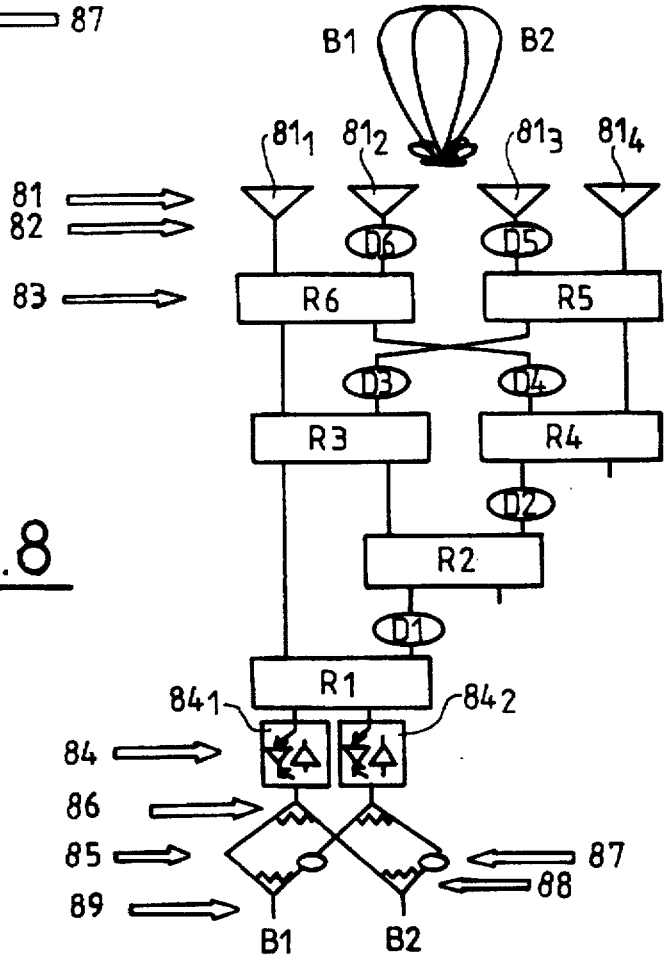
FIGS. 8 and 9 respectively represent one embodiment and one particularly advantageous embodiment of the invention, in the case when Ne=4 and Na=Nb=2.
Figure 9:
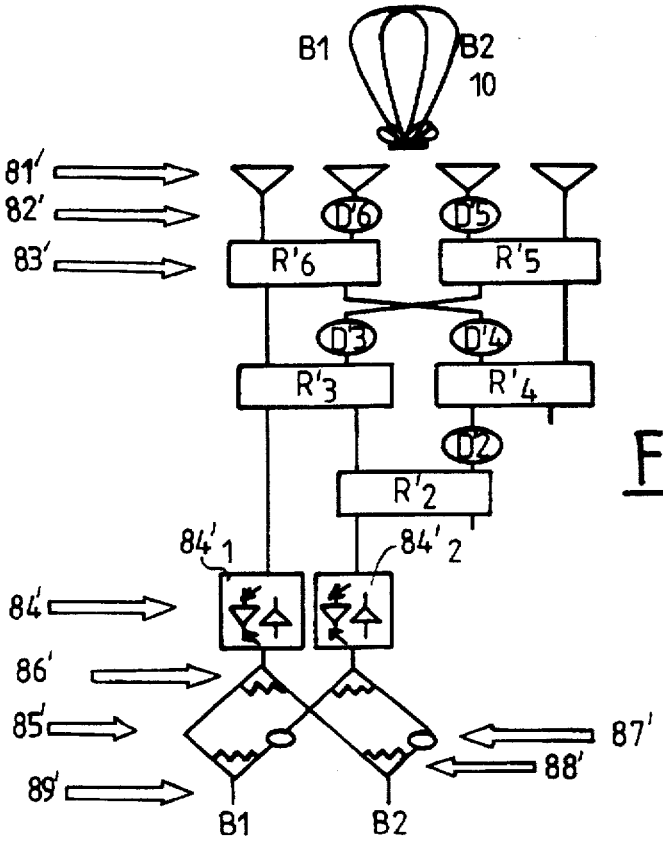

FIGS. 8 and 9 illustrate another simple embodiment of the device of the invention, with Ne=4, Na=Nb=2, FIG. 9 constituting a simplified variant of FIG. 8.

Figure 10:
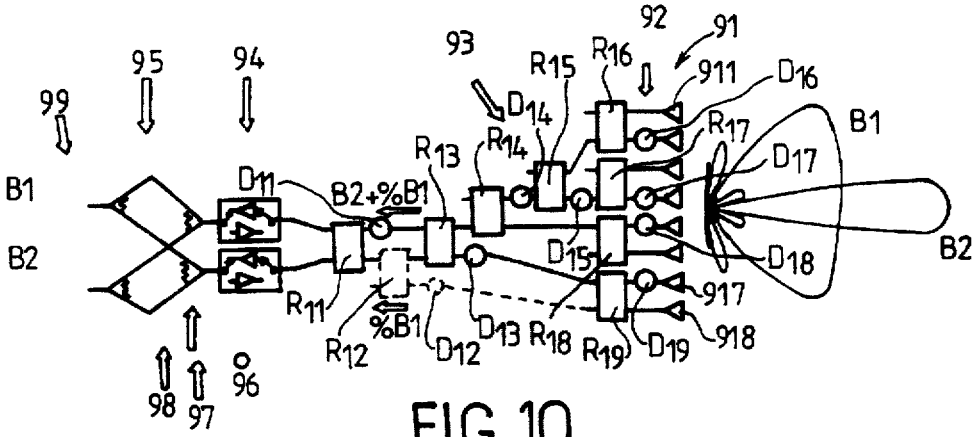
FIG. 10 represents one embodiment of the invention in the case when Ne=8 and Na=Nb=2.

FIG. 10 illustrates another simple embodiment of the device of the invention, with Ne=8, Na=Nb=2.

The configurations in FIGS. 7 to 10 are discussed in more detail in the following section.

Figure 11A:
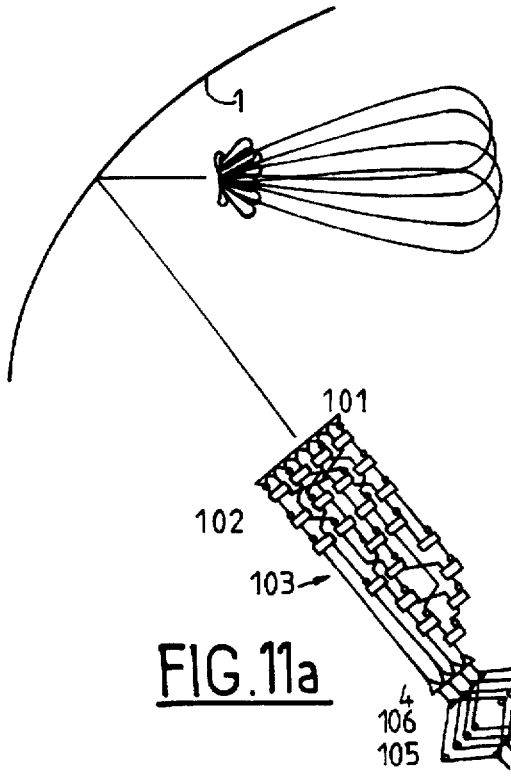
FIGS. 11*a* and 11*b* represent two embodiments of the invention, corresponding to the case when Nb=Na =4 and Ne=8, respectively with a cascade matrix and with a Blass matrix.
Figure 11B:
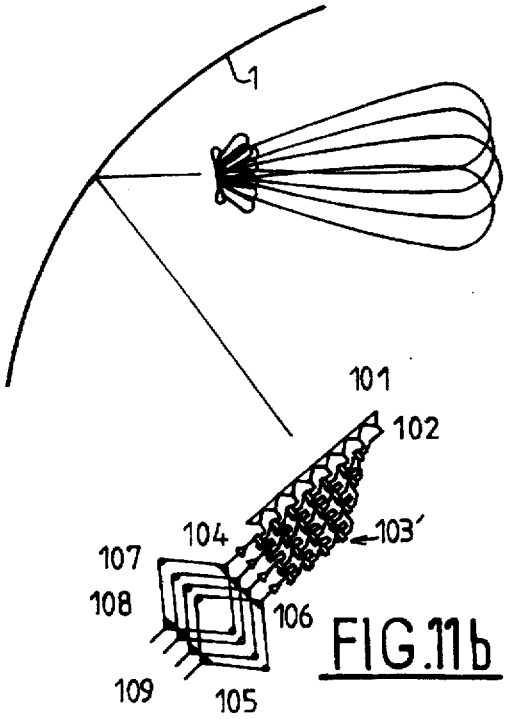

FIGS. 11*a* and 11*b* illustrate in more detail two embodiments in which the splitter is of the cascade type, ref. 103 (FIG. 11*a*), or of the Blass type, ref. 103' (FIG. 11*b*), for the generation, here in transmission, of Nb=4 nonorthogonal beams with overlaps. The splitter 103 includes 24 directional modules which are interconnected as represented in FIG. 11*a*. The splitter 103' includes 22 modules interconnected as represented in FIG. 11*b*.

The device (here with Ne=8, Na=4 and Nb=4) includes:

Ne radiating elements 101, connected to transmission lines 102 and illuminating a reflector 1, a microwave splitter 103 or 103' with Na inputs and Ne outputs, with Nb≦Na≦Ne, nominally without losses and with an orthogonal transfer matrix, the Ne outputs of which are connected to the Ne radiating elements 101 by transmission lines 102.

Each of the prescribed Nb beams is emitted from some or all of the Ne elements with a specific amplitude and phase distribution which is optimized for each beam as if the antenna were to generate only this beam. Such an optimization is performed with the aid of conventional optimization programs of the minimax or multiple-projection type, which procedures are known to those skilled in the art (see, for example, the work "The Handbook of Antenna Design", edited by A. Rudge et al., 1986, p 263).

A microwave splitter 63 (FIG. 6) according to the invention typically consists of hybrid couplers (which are generally not at 3 decibels), associated with fixed phase shifters or line or waveguide sections, these components being connected in cascade by lines or waveguides. The splitter 63, termed orthogonal or multimode, belongs to the family used, for example, for conventional shaped-beam multimode antennas (in category II of the preceding section).

Figure 1A:
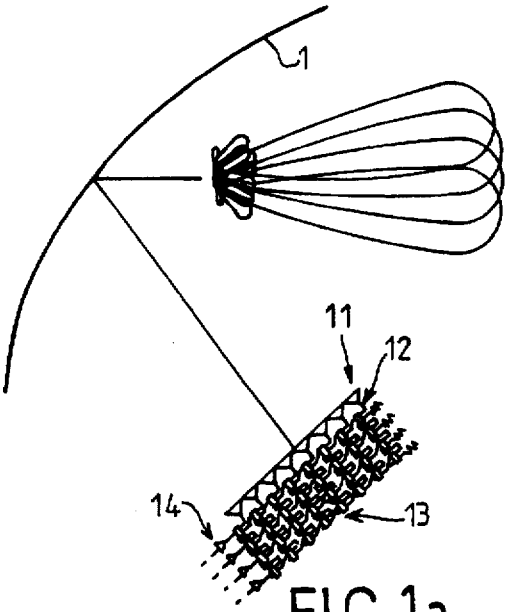
FIGS. 1*a* and 1*b* represent a lossy multimode antenna.
Figure 1B:
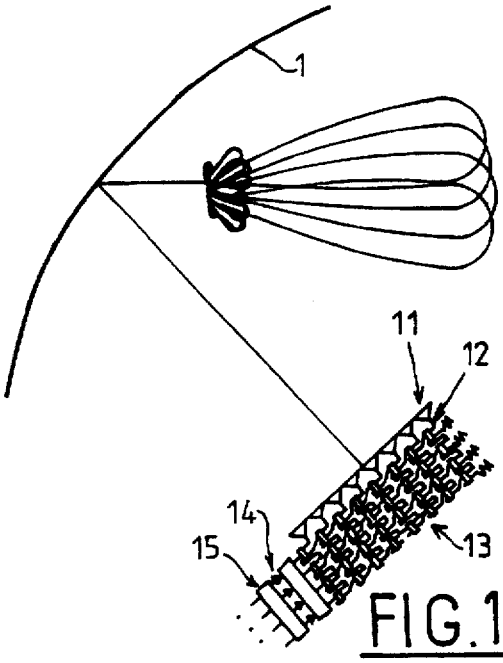
Figure 2A:
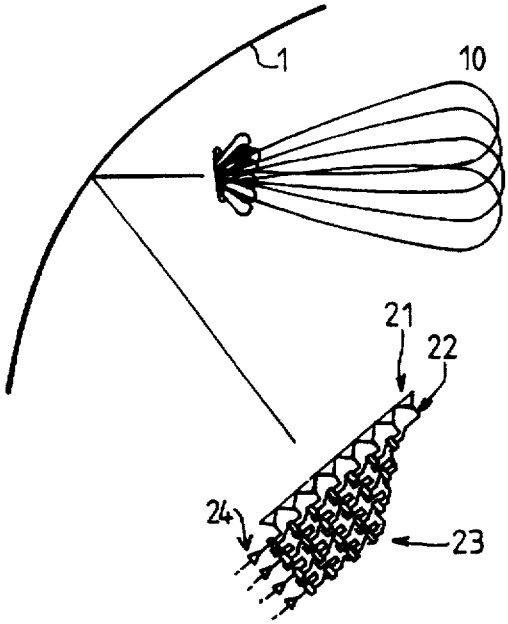
FIGS. 2*a* and 2*b* represent a Blass-matrix multimode antenna.
Figure 2B:
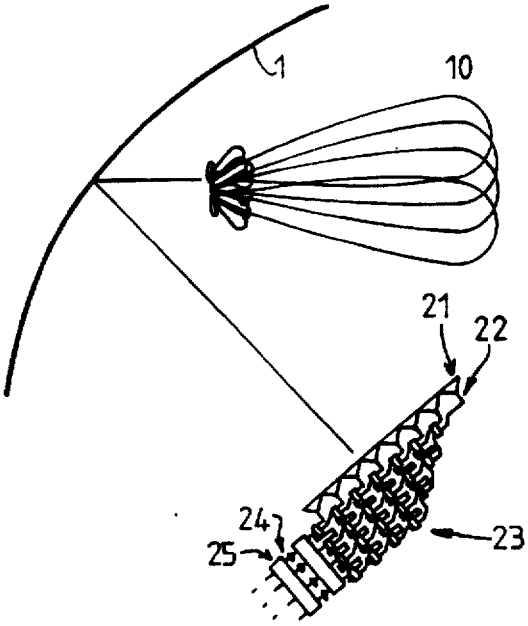
Figure 3A:
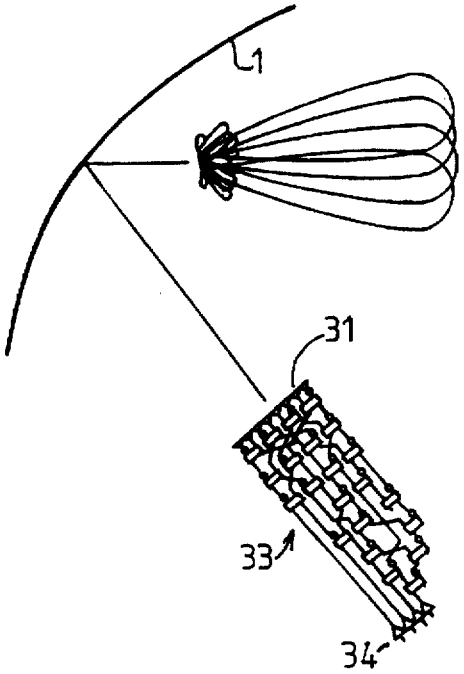
FIGS. 3*a* and 3*b* represent a cascade-matrix multimode antenna.
Figure 3B:
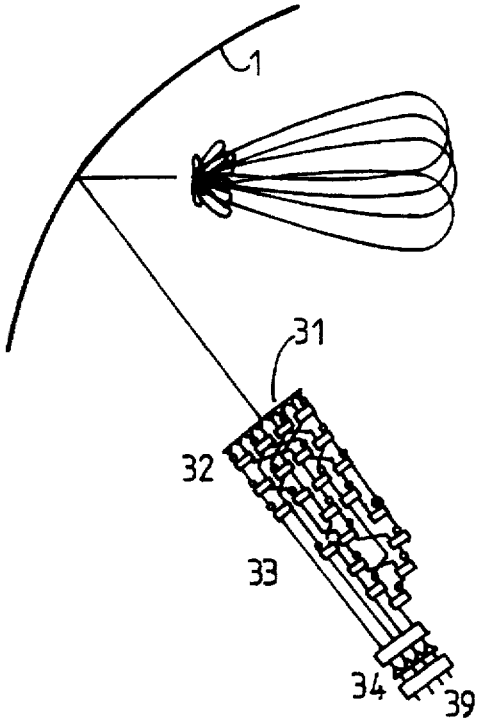
Figure 5:
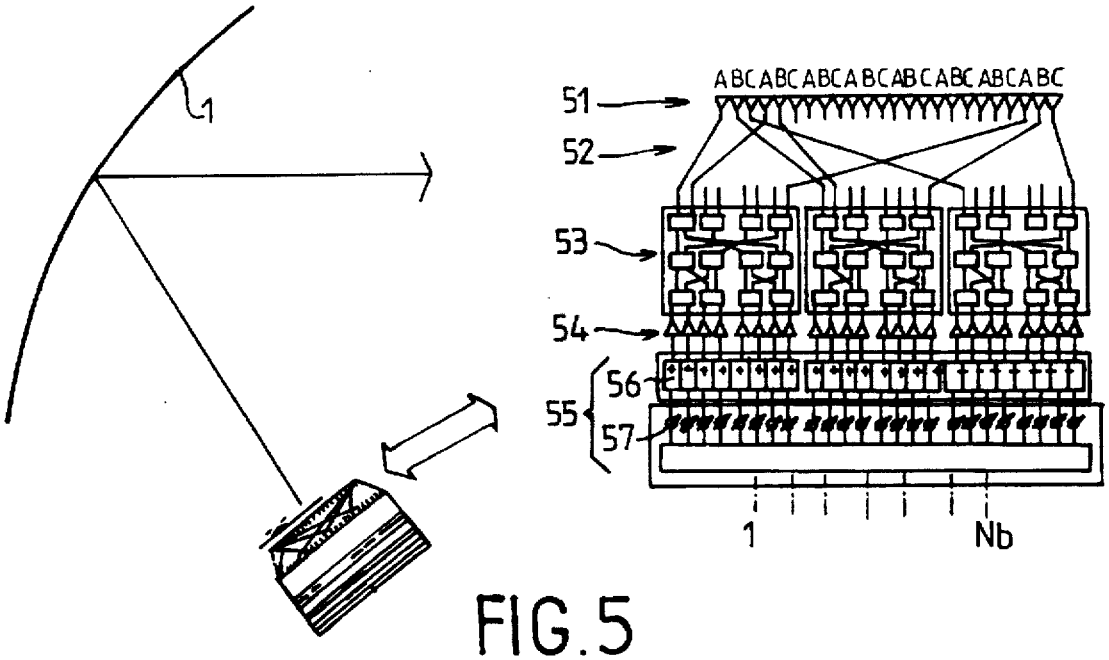
FIG. 5 represents a semiactive multimatrix antenna; these antennas, belonging to the prior art, have been presented above.
Figure 4:
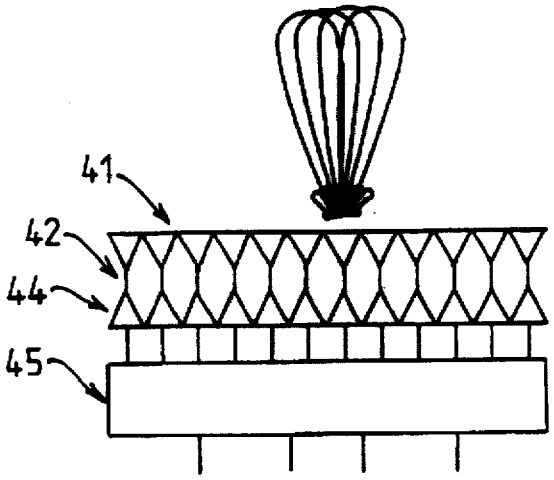
FIG. 4 represents an active array antenna.

The freedom to select the number of amplifiers Na, between the number Nb of producible beams and the number Ne of radiating elements, represents an important new possibility. In existing systems, Na is always equal either to the number Nb of beams, in the case of passive systems (FIGS. 1*a*, 1*b*, 2*a*, 2*b*, 3*a*, 3*b*), or equal to the number Ne of radiating elements, in the case of active systems (FIG. 4) or semiactive systems (FIG. 5).

The function of the power splitter 63 employed according to the invention is to make Nb distributions at Na input ports, all with equal amplitudes, correspond exactly to Nb given distributions at the Ne radiating elements, which are generally not orthogonal, with Nb≦N≦Ne.

Existing hybrid microwave splitters cannot fulfil this function when the prescribed distributions are not orthogonal.

The splitter 63 has a transfer matrix which makes said distributions correspond exactly with each other and which is determined by employing the following design rules.

After determining, at the radiating elements, the Nb optimum distributions (or "output vectors") corresponding to the Nb prescribed beams, it is designed in two stages described below:

a) the transfer matrix of the output power splitter must be orthogonal (nominally without losses). The scalar products of the Nb complex excitation vectors at the input of the splitter, taken in pairs, are equal to the known scalar products of the Nb corresponding output excitation vectors, so as to respect this condition. For each of the Nb beams, the condition is set that the Na amplitudes of the distributions at the input of the splitter are equal. Na×Nb input phases then remain to be determined. The phases of the first distribution can be made zero by integrating a phase shifter with each input of the splitter. Na×[Nb-1] input phases then remain to be determined.

The equalities of complex scalar products taken in pairs provide 2×Nb!/[[Nb-2]!×2!]=Nb×[Nb-1] equations making it possible to determine, by an optimization program which is conventional in the technical field of the invention, the Na×[Nb-1] desired phases of the input signals, if Nb<Na, and to do this uniquely, and therefore by calculation without the requirement of using an optimization program, if Na=Nb.

b) Nb distributions at the input of the splitter, for example 63, and the Nb corresponding output distributions, given at the start are therefore known. The determination of the transfer matrix of the output splitter 63 converting Nb known complex input vectors with Na components into Nb known output vectors with Ne components is unique in the case when Nb=Na, that is to say if the number of amplifiers is equal to the number of beams. It will be noted that this particular case is favorable since it makes it possible, for a semiactive system, to reduce the number Na of amplifiers, it being understood that the number Ne of radiating elements is in general greater or even very much greater than the number Nb of beams. In order to determine this matrix, it is sufficient to write the Nb complex transfer equations for each of the Nb vectors, which provides Nb×Nb complex equations, on the basis of which the determination of the Nb×Nb complex coefficients of the transfer matrix corresponding to the transfer function of the splitter is unique. This calculation is given by conventional matrix algebra.

If it is desired to have more amplifiers than beams (within the limitation Na≦Ne), the additional degrees of freedom can be used to simplify the output splitter by introducing up to (Na-Nb)(Nb-1) corresponding additional constraints into the optimization process.

The transfer function of the high-level splitter and the input excitation phases are thus determined.

Synthesis of a microwave splitter 63 with known orthogonal transfer matrix can be implemented with architectures 103 with hybrid couplers and cascade phase shifters 102 (FIG. 11*a*), or 103' with Blass-type splitters 102' (FIG. 11*b*).

Figure 6:
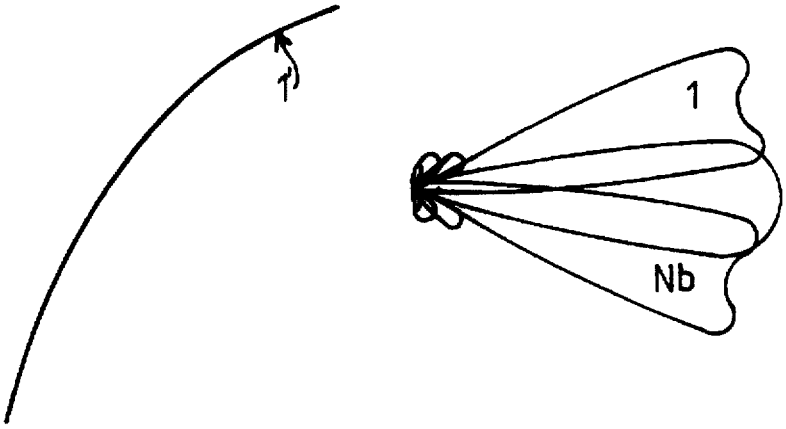
FIG. 6 represents a diagram of a semiactive antenna according to the present invention.
Figure 6:
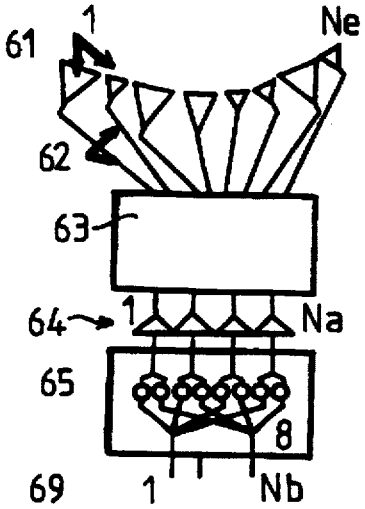
Figure 12:
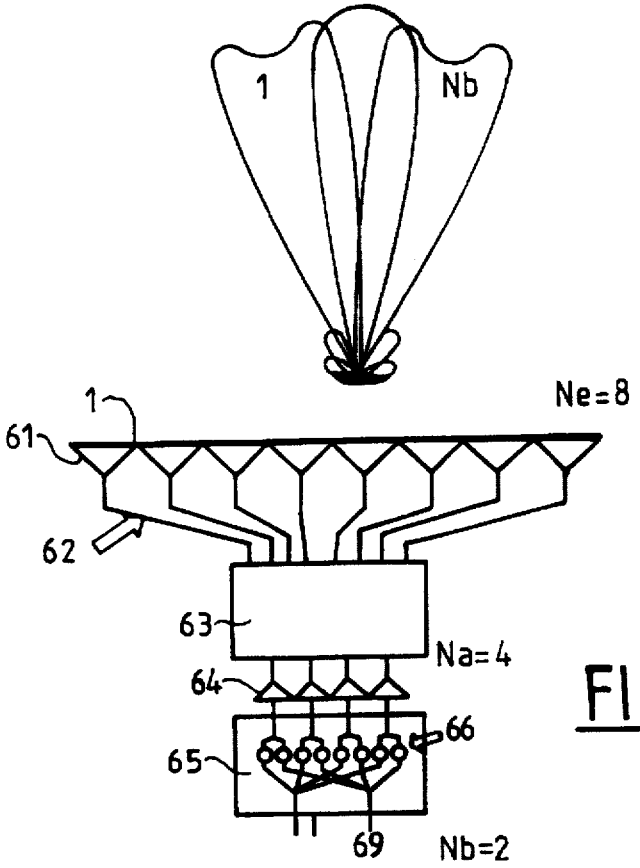
FIG. 12 represents a variant of the embodiment in FIG. 6, corresponding to the case when Nb=2, Na=4 and Ne=8.
Figure 18:
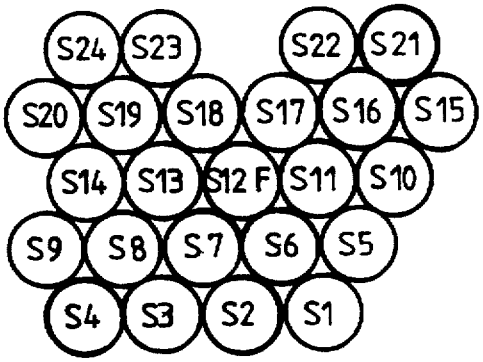
FIGS. 18 and 19 illustrate one preferred embodiment of the arrangement of the 24 sources S1 to S24 and of the geometry of the antenna, with a view to producing the aforementioned four beams.
Figure 19:
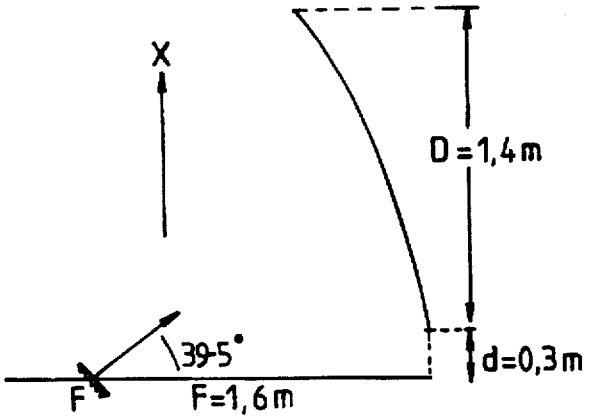

According to FIGS. 6 and 12, which illustrate the general case of a device according to the invention, the feed device also includes a splitter/phase shifter 65 with Nb inputs (with Nb≦Na) and Na outputs, the Na outputs of which are associated with the Na inputs of the microwave splitter 63, if necessary via converters,and the Nb inputs of which correspond to the Nb required beams.

In transmission, this splitter/phase shifter 65 splits into Na the signals applied to each of the Nb beam inputs and suitably phase shifts each of the Na signals obtained for each beam using phase shifters 67. The signals of the various beams are, after phase shifting, recombined on each of the Na outputs of the splitter/phase shifter 65 by a combiner 66. The combiner 66, which constitutes the low-level beam shaper device, and which remains of conventional design, is the seat of losses, associated with the nonorthogonality of the beams, which, at this level, do not affect the efficiency (or, on reception, the noise) of the system.

The Nb dividers, dividing each of the beams into Na signals, and the Na combiners 66 may, for example, be of the "Wilkinson" type, if the splitter 65 operates in the microwave range. The device also includes Na nominally identical amplifier modules 64 which are inserted between the outputs of the splitter/phase shifter 65, if necessary via frequency converters, and the Na inputs of the splitter 63, if necessary via Na filters (not shown in FIG. 6).

Other modules may be added to the Na amplifiers in order to ensure redundancy in the event of breakdown. In transmission, these Na amplifiers amplify the power of the signals to be transmitted.

In reception mode, these Na amplifiers are identical low-noise amplifiers and amplify the microwave signals which they receive from the splitter 63.

The device according to this embodiment of the invention thus has, in combination, the radiating elements 61, the lines 62, the orthogonal microwave splitter 63 and the amplifier modules 64, all operating under nominal or quasi-nominal conditions, as well as the splitter/phase shifter 65.

In transmission, the signals applied to each of the inputs of the low-level splitter 65 are subdivided and phase shifted in fixed or reconfigurable optimum fashion, and are amplified by the amplifiers 64. They are then distributed by the high-level splitter 63 to the radiating elements 61 with the optimum amplitudes and phases for each generating corresponding beams.

The power radiated by each beam can be controlled by switching more or fewer channels to the corresponding inputs of the low-level splitter 65, which leads to total traffic reconfigurability.

The coverage reconfiguration is performed either by activation of the desired fraction of the Nb available beams or by action on the variable phase shifters 67, if there are any, or by a combination of the two.

The device of the invention also operates in reception and makes it possible to limit the received noise while ensuring the optimum gain for each beam. The amplifiers 64 are then replaced by low-noise amplifiers which amplify the received signals output by the microwave splitter 63.

A simplified configuration of the device (FIG. 7) of the invention, which is of particular interest, is that obtained when Ne=Na=Nb=2. The orthogonal microwave splitter 73 then reduces to the assembly consisting of a fixed phase shifter $\mathbf{73}_1$, producing a phase shift 4, and of a directional coupler $\mathbf{73}_2$ characterized by its directionality ratio r with $0 \leqq r \leqq 1$, the phase shifter $\mathbf{73}_1$ or line or guide section being inserted between the directional coupler and one of the radiating elements $\mathbf{71}_2$. In transmission, for any two prescribed beams, coherent signals with equal amplitudes and optimized phases at the two input ports (power amplifiers) emerge with the desired amplitudes and phase to produce these beams. In reception, for each beam, the unequal signals received by radiating elements emerge equal in amplitude at the (low-noise) amplifier outputs. In order to calculate the phase shift $\phi$ for the phase shifter and the ratio r for the coupler on the basis of the desired excitations for each of the two beams at the radiating elements, it is sufficient, for given complex signals (in reception), to write the two equations of equality of the "input" amplitudes, the input term corresponding to the definition given above, in the ratio of one per beam. The unknown $\phi$ and r are deduced from these two equations. The change from reception to transmission takes place using reciprocity.

This device is useful for facilitating the synthesis of two-beam systems (Nb=2) with more than two elements, by successive equalization of the signals at 10 several levels, proceeding from the radiating elements 71 to the amplifiers 74, the number of the latter remaining equal to the number of radiating elements 71.

Another configuration of the device (FIG. 8) of the invention, of particular interest, is that obtained when Ne=4, Na=Nb=2. The orthogonal microwave splitter 83 then reduces to an assembly consisting of six directional couplers ($R_1 \ldots R_6$), each characterized by its directionality ratio and each associated with a fixed phase shifter (D1 . . . D6), each phase shifter or line or guide section being connected to one of the output ports of the corresponding directional coupler ($R_1 \ldots R_6$). In transmission, for any two prescribed beams, coherent signals with equal amplitudes and optimized phases at the two input ports (power amplifiers) emerge with the desired amplitudes and phase to produce these beams. In reception, for each beam, the unequal signals incident on the elements $\mathbf{81}_1$ to $\mathbf{81}_4$ emerge equal in amplitude "at the outputs" of the (low-noise) amplifiers 84.

The phase-shifter modules comprising the three couplers $R_3$, $R_5$ and $R_6$ and their associated phase shifters $D_3$, $D_5$ and $D_6$ are calculated so as to concentrate, in reception mode, the power of the first beam to a single "input" port of these modules, which in this mode functions as an output. This calculation can be performed in a known manner.

The two directional couplers $R_2$ and $R_4$ and the associated phase shifters $D_2$ and $D_4$ are calculated, in reception mode, so as to concentrate the available power of the second beam $B_2$ to a single "input" port of each of the couplers $D_2$ and $D_4$. Finally, the last (lower) coupler $R_1$ and the associated phase shifter $D_1$ are calculated in reception mode so as to equalize, for each beam ($B_1$, $B_2$), the powers at the two "input" ports, which in this mode function as outputs (by using the same method as for the coupler and phase shifter of the preceding device (FIG. 7)).

The change from reception to transmission takes place using reciprocity.

This device is useful for facilitating the synthesis of two-beam systems (Nb=2) with more than four elements (Ne≧4), by successive equalization of the signals at several levels, proceeding from the radiating elements $81_1$ to $81_4$ to the amplifiers $84_1$ to $84_2$, the number of the latter being less than that of the radiating elements $81_1$ to $81_4$.

A simplified configuration of the device in FIG. 8 is represented in FIG. 9, in which the elements corresponding to those in FIG. 8 have the same reference number suffixed by the sign "'". The directional coupler $R_1$ and its associated phase shifter $D_1$ have been removed. The device includes five directional couplers ($R'_2 \ldots R'_6$) and their five associated phase shifters ($D'_2 \ldots D'_6$) which are interconnected like the directional couplers ($R_2 \ldots R_6$) and the phase shifters ($D_2 \ldots D_6$), with the exception that one input of the couplers $R'_2$ and $R'_3$ is connected to the output of an amplifier $84'_2$ and $84'_1$, respectively.

The values of the ratios r of the directional couplers ($R'_2 \ldots R'_6$) and of the phase shifts $\phi$ of the phase-shifter elements ($D'_2 \ldots D'_6$) are determined according to the general method indicated above, namely:

Equal amplitudes are set on each input of the couplers ($R'_2 \ldots R'_6$) for the two input distributions I1 and I2 corresponding to the two desired output distributions O1 and O2.

Without loss of generality, it is possible to phase shift one of the desired output distributions, for example O2, to make the scalar product P12 of the output distributions O1 and O2 real, with P12=cos ($\phi$12).

It is also possible to choose the first input distribution I1 to be real, by adding a phase shifter (not shown) on each input.

Equality of the scalar product of I1 and I2 with the scalar product P12 of O1 and O2 leads to equal and opposite phases for the two components of I2. Their value is$\pm\phi$12.

The output distributions T1 and T2 are then easily found, which correspond respectively to I1=(1,0), corresponding to a signal present on the input B1 only, and I2=(0,1), corresponding to a signal present on the input B2 only, T1 and T2 being linear combinations of O1 and O2.

The following reasoning is then adopted for reception:

For $Ti^*$ (the conjugate of T1) incident on the four radiating elements $81'_1$ to $81'_4$, the modules $R'_5$ and $R'_6$ are chosen such that the power is concentrated on only one of their inputs, these two inputs being those connected to the module $R'_3$, calculated in such a way that the received power is concentrated on its port connected directly to one of the power modules $84'_1$.

Next, $T2^*$ is incident and the directional module $R'_4$ is calculated so that the power is concentrated on only one of its inputs, the other being unused. The used input of the module $R'_4$ is connected to the first output of the module $R'_2$ which, in reception mode, receives at its other output the power coming from the directional module $R'_3$. The module $R'_2$ is calculated so as to concentrate the received power to a single input, the one connected to the other power module $84'_2$. The other input of the module $R'_2$ is unused.

The device in FIG. 10 illustrates the case of an array antenna (here with eight sources) producing two beams B1 and B2, one emitted by two sources and the other by the eight sources. These beams, with different widths, are clearly nonorthogonal (about the axis, the power incident on the antenna can clearly not be completely picked up by the beam B2 without a fraction going to the beam B1, whence a loss compared to the case of a single beam).

One known way of avoiding the impact of this loss is to associate an amplifier module with each of the eight radiating elements (this results in eight modules and a 2×8 splitter).

With the device of the invention, the non-orthogonality loss is also eliminated, but there are then only two amplifier modules and one similar splitter.

The device in FIG. 10 more particularly has a simplified configuration of the device of the invention, when Ne=8, Na=Nb=2. The beam B1 is emitted by the two radiating elements $91_7$ and $91_8$, and the beam B2 is emitted by all eight radiating elements $91_1$ to $91_8$. The orthogonal microwave splitter 93 then reduces to an assembly consisting of nine directional couplers $R_{11}$ to $R_{19}$, each characterized by its directionality ratio r and each associated with a fixed phase shifter $D_{11}$ to $D_{19}$, each phase shifter or line or guide section being connected to one of the ports of the corresponding coupler. In transmission, for any two prescribed beams, coherent signals, with equal amplitudes and optimized phases, present at the two input ports of the power amplifiers 94 emerge with the desired amplitudes and phases to produce these beams B1 and B2. In reception, for each beam, the unequal signals incident on the elements $91_1$ to $91_8$ emerge equal in amplitude at the "inputs" of the amplifiers 94.

The seven couplers $R_{13}$ to $R_{19}$ and the associated phase shifters $D_{13}$ to $D_{19}$ in FIG. 9 are calculated so as to concentrate the power of the beam B2 toward a single input port of the couplers $R_{13}$ to $R_{19}$. The coupler $R_{12}$ and associated phase shifter $D_{12}$ (shown in dashes) concentrate the power of B1 on a single input port of the coupler $R_{12}$. The input coupler $R_{11}$ equalizes the powers for B1 and B2 at each of its "inputs" in the direction of the amplifiers (by using the same method as for the coupler and the phase shifter in FIG. 7). The calculations are made in reception, the "inputs" of the couplers in this case functioning as outputs according to the definition given above.

The change from reception to transmission takes place using reciprocity.

Figure 13:
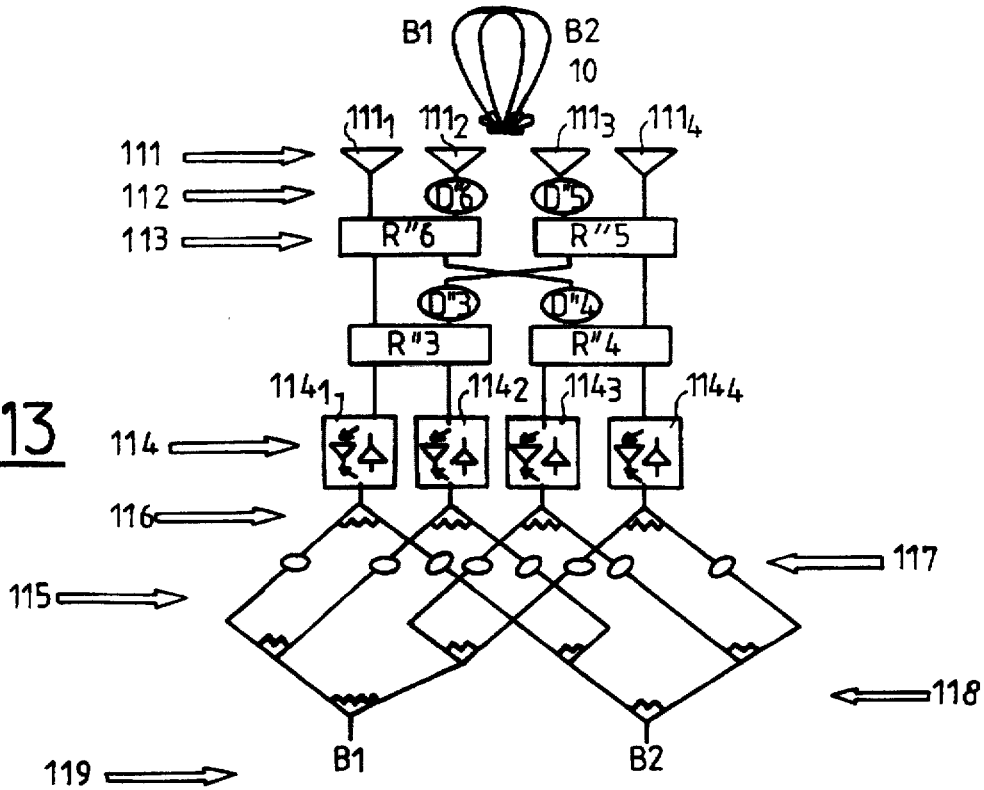
FIG. 13 represents one embodiment of the invention, in the case when Ne=4, Na=4 and Nb=2.

According to the embodiment in FIG. 13 (Nb=2, NeNa=4), the power splitter includes four directional modules ($R''_3$,$D''_3$) ($R''_4$, $D''_4$) ($R''_5$, $D''_5$) and ($R''_6$, $D''_6$) which are interconnected like the directional modules ($R'_3$, $D'_3$) . . . ($R'_6$, $D'_6$) in FIG. 9.

The directional ratios and the phase shifts are determined in the following manner:

The directional modules ($R''_5$, $D''_5$) and ($R''_6$, $D''_6$) are calculated in reception mode, so as to equalize the amplitudes of the signals on each of their inputs, this being done for each distribution (beam) incident on the elements $111_1$ to $111_4$. Similarly, the two directional modules ($R''_3$, $D''_3$) and ($R''_4$, $D''_4$) are calculated in such a way as to equalize the amplitudes on each of their inputs, this being done for each incident distribution (beam). In transmission, the desired distributions, and consequently beams, are obtained by reciprocity on the basis of distributions, with uniform amplitude, at the inputs of the amplifiers $114_1$ to $114_4$.

Figure 20:
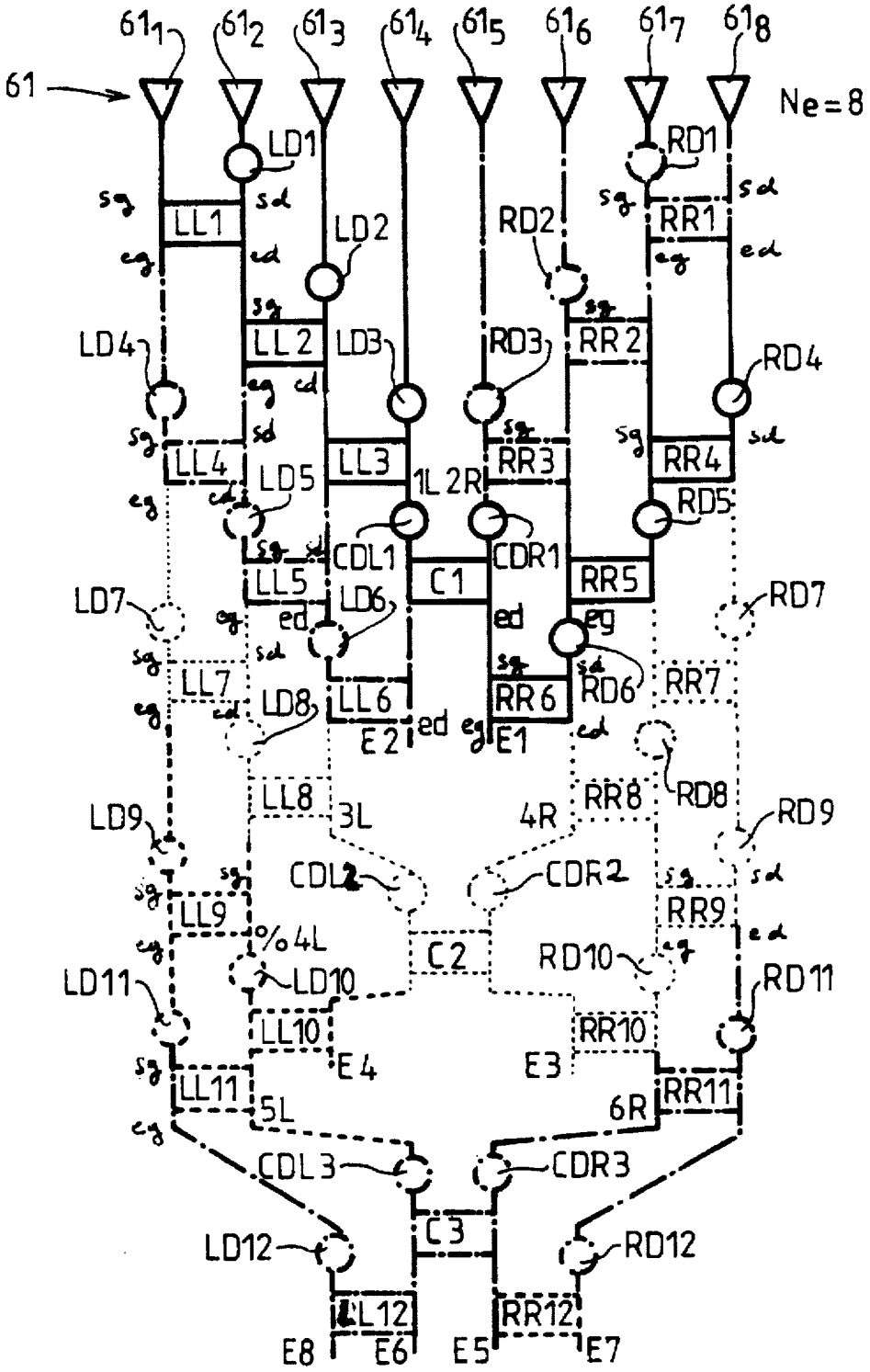
FIG. 20 represents one preferred embodiment of a power splitter according to the invention.

FIG. 20 represents a preferred architecture of the power splitter 63. Its advantage is that it is symmetrical and has no crossover, such as, for example, those between the elements R3 to R6, or R'3 to R'6 or R"3 to R"6 in FIGS. 8, 9 and 13. It can be used in place and instead of the cascade splitters in FIGS. 3*a*, 3*b*, 8, 9, 11*a* and 13, or else the Blass matrices in FIGS. 1*a*, 1*b*, 2*c*, 2*b* and 11*b*. This architecture can also be used for numerous other applications: this power splitter per se constitutes a lossless microwave power divider.

The architecture represented corresponds to the cases when Na=Ne=8.

The splitter includes eight input ports E1 to E8 (Na=8) and eight output ports corresponding to the eight antennas 61 (Ne=8).

The transfer matrix of the 8×8 splitter is first of all determined by using the design rules described above, on the basis of the Nb optimum distributions or "output vectors" corresponding to the aforementioned Nb beams.

The term "complex distribution" hereafter denotes the complex conjugate of a row in the complex transfer matrix.

The matrix comprises hybrid complexes associated with phase shifters. The arrangement is symmetrical and includes:

- a central row of hybrid couplers with two inputs and two outputs, referenced C1 to C3 in the direction from the output (antennas 61) to the input. Each hybrid coupler has a phase shifter at each of its outputs, respectively CDL1 and CDR1 for C1, CDL2 and CDR2 for C2 and CDL3 and CDR3 for C3;
- a "left" group of hybrid couplers with two inputs and two outputs, referenced LL1 to LL12 in the direction from the output to the input, which have at one of their outputs a phase shifter LD1 to LD12, respectively, this phase shifter being arranged in the output sg arranged at the left on the drawing, for the couplers LL4 to LL12, and in the output sd at the right on the drawing, for the couplers LL1 to LL3, the right outputs sd of which are applied to the corresponding antennas $61_2$ to $61_4$, via one said phase shifter (respectively LD1, LD2, LD3), the left output of the coupler LL1 being directly applied to the antenna element $61_1$ located furthest to the left;
- a "right" group of hybrid couplers with two inputs and two outputs, referenced RR1 to RR12 in the direction from the output to the input, which have at one of their outputs a phase shifter RD1 to RD12, respectively, this phase shifter being arranged in the output sd arranged at the right on the drawing, for the couplers RR4 to RR12, and in the output sg at the left on the drawing, for the couplers RR1 to RR3, the left output of which is applied to the corresponding antennas $61_5$ to $61_7$, via one said phase shifter (respectively RD1, RD2, RD3), the right output of the coupler RR1 being directly applied to the antenna element $61_8$ located furthest to the right.

The hybrid couplers are connected in seven lines of cascaded couplers, namely:

- a first line composed, in the downstream to upstream direction, of the couplers LL1, LL4, LL7, LL9, LL11 and LL12;
- a second line composed of the couplers LL2, LL5, LL8 and LL10;
- a third line composed of the couplers LL3 and LL6;
- a central line composed of the couplers C1, C2 and C3;
- a fifth line composed of the couplers RR3 and RR6;
- a sixth line composed of the couplers RR2, RR5, RR8 and RR10;
- a seventh line composed of the couplers RR1, RR4, RR7, RR9, RR11 and RR12.

At the interfaces between the lines, the couplers are connected in cascade alternately with those of the adjacent line (except for the couplers C1 to C3), namely:

output of the right branch of LL12, then input and output of the left branch of C3, of the right branch of LL11, of the left branch of LL10, of the right branch of LL9, of the left branch of LL8 and so on for LL7, LL5, LL4, LL2 and LL1 with the interposition of the phase shifters CDL3, LD10, LD8 and LD5, the right output of LL1 being applied to the antenna element $62_2$ through the phase shifter LD1.

For determination of the hybrid couplers and phase shifters, operation is carried out in reception mode: it is assumed that the signals of the complex distributions are received on the eight antenna elements and that the splitter routes each of them to the corresponding input port.

The example below corresponds to the case Nb=Na.

The hybrid couplers LL1, LL2 and LL3, as well as the phase shifters LD1, LD2 and LD3, are chosen in such a way as to direct the signals, originating from the first distribution and available on the antenna elements $61_1$ to $61_4$, to the right input ed of the coupler LL3.

The same operation is carried out, in symmetry, at the hybrid couplers RR1, RR2 and RR3 and their phase shifter RD1, RD2 and RD3, for the signals of a second distribution, orthogonal to the first, which are received on the other antenna elements $61_5$ to $61_8$ furthest to the right. These signals of the second distribution are thus routed to the left input eg of RR3. The next two couplers LL4 and LL5 and the corresponding phase shifters LD4 and LD5 are determined so as to direct the signals of the second distribution, which are received on the antenna elements $61_1$ to $61_4$, to the right input ed of the coupler LL5 (the term "input" being defined in a transmission mode configuration).

The two couplers RR4 and RR5 and their associated phase shifters RD4 and RD5 are determined so as to direct the signals of the first distribution, which are received on the antenna elements $61_5$ to $61_8$, to the left input eg of the coupler RR5.

The coupler C1 and the associated phase shifters CDL1 and CDR1, the outputs of which are applied to the right and left inputs, respectively, of LL3 and RR3, are determined so as to direct the signals of the first distribution, which are present at the right input ed of LL3, to the right input port ed of the coupler C1.

The signals of distributions 1 and 2 are therefore distributed over four input ports, namely the right port ed of the coupler LL5, which in reception mode receives signals only of the second distribution, the left port eg of the coupler RR5, which in reception mode receives signals only of the first distribution, the left input port eg of the coupler C1, which receives signals of the second distribution but receives no signal of the first distribution, since the latter is directed only to the right port ed of the coupler C1, and finally the right input port ed of the coupler C1, which receives signals of the first distribution but on which there cannot, by assumption, be any signal of the second distribution, or else the scalar product of these two distributions would be other than zero, which would be contrary to the orthogonality criterion which has been set.

The coupler LL6 and its associated phase shifter LD6 are configured in such a way as to direct the signals of the second distribution, which are present at the port eg of C1 and at the port ed of LL5, to its right input port ed, which constitutes the input E2, and the coupler RR6 and its associated phase shifter DD6 are configured so as to direct the signals of the first distribution, which are present on the port ed of C1 and on the port eg of RR5, onto the left input port eg of RR6, which constitutes the input E1.

It will be noted that the set of couplers C1, LL1 to LL6, RR1 to RR6, and their associated phase shifters, constitute an orthogonal and symmetrical hybrid coupler with two inputs (E1, E2) and eight outputs (Na=2 and Ne=8).

The couplers and the associated phase shifters may be selected using the beams 3 and 4, 5 and 6, and finally 7 and 8, by using the same procedure, in order to lead to an 8×8 coupler (Nb=Na=Ne=8). The same procedure is suitable for any even input and output number.

Another simplified configuration of the device of the invention can be obtained by relaxing the constraint of strict equality of the signals of each beam at each amplifier module, by tolerating a small "ripple" of, for example, ±1 dB. The components of the splitter are then optimized by a conventional optimization procedure, by setting a maximum "ripple" at the amplifier modules.

Some or all of the phase shifters employed in the context of the present invention may also be variable, in order to reconfigure some or all of the beams, for example if a satellite changes its coverage. The power splitter must then be dimensioned for all the producible beams, which are not all activated at the same time. The phase shifters may be analog or quantized (digital).

The splitter/phase shifter 65 can operate in the microwave range at the transmission (or reception) frequency. Amplification may, if necessary, be produced at the inputs of the splitter/phase shifter 65.

The splitter/phase shifter 65 can also operate at an intermediate frequency; a frequency converter is then connected to each of its Na outputs.

The splitter/phase shifter 65 may also be of ditigal type. It is then followed by digital/analog converters and possibly frequency converters.

The radiating sources 101 may be direct-radiation sources and be arranged over a surface which is, for example, planar (referenced 1 in FIG. 12), cylindrical, conical, spherical, or over a different surface.

The device of the invention may be associated either with a reflecter 1' (FIG. 6) or a lens. The device may be associated with a multireflector or multi-lens system or with a system having a mixture of reflectors and lenses.

The device according to the invention may be associated with a reflector, or a lens, designed to improve performance. The device according to the invention may in particular be associated either with an overdimensioned reflector, or with a lens.

In the case when the device according to the invention is associated either with a reflector or with a lens, the surface over which the sources are located can be optimized or displaced around the focus.

As emerges from the above description, the essential advantage of the device is that it can exactly generate nonorthogonal amplitude and phase distributions on the radiating elements, and therefore overcome the directionality losses associated with the constraints of conventional multimode splitters and with multimatrix systems. All the amplifiers 64 can operate at (or close to) their nominal level, which produces for transmission the best power efficiency regardless of the conditions in allocation of channels to the beams.

In the case when the number Na of amplifiers common to the beams is equal to the number Nb of beams to be produced, the complexity of the output splitter of the device is exactly the same as for a conventional (passive) multimode splitter designed to generate the same beams with one amplifier module per beam (FIGS. 3, 11*a* and 11*b*).

This results from the fact that the orthogonal matrices, although very different in their functions and in the values of their components, have the same number of input and output ports, Na and Ne, respectively, and consequently the same number of couplers (Ne-1+Ne-2+. . . +Ne-Na).

There is therefore, with the same complexity and the same technology, the advantage of superior directionality for each beam.

The flexibility for allocation of power to the beams, with optimal efficiency of the amplifiers in transmission, is an intrinsic quality of the device.

Since the output splitter is lossless, the activated beams can be reconfigured by readjusting the corresponding phases at the input of the amplifiers.

In its configuration when operating in reception, the device retains the advantage of enhanced directionality compared to conventional multimode (passive) splitters.

Compared to a conventional active or semiactive antenna, it makes it possible to reduce the number of low-noise amplifiers from Ne to Nb (number of beams), which may be very much less.

Figure 14:
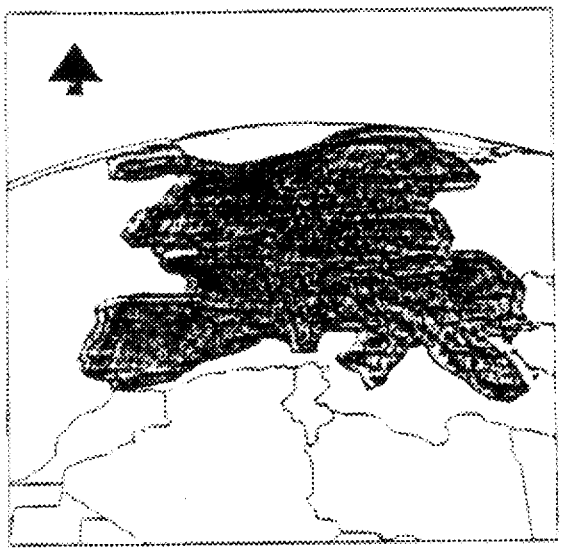
FIGS. 14 to 17 represent the coverage of four beams (Nb=4) from a geostationary satellite antenna with Ne=24 sources, respectively "Pan European", "GB/Europe", "IT/Europe" and "Spain/Europe"
Figure 15:
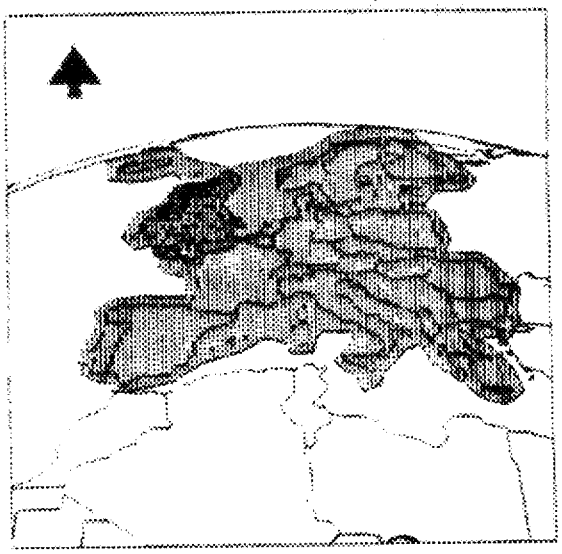
Figure 16:
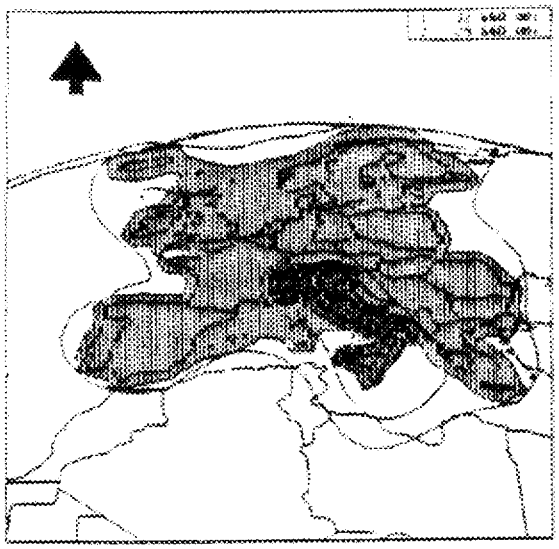
Figure 17:
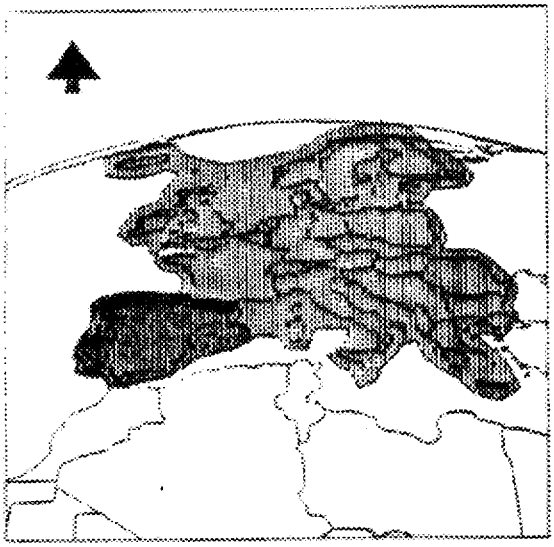

The device of the invention was evaluated for the generation of four beams (Nb=4) from one geostationary satellite antenna:

The four beams are:

1) Pan-European (FIG. 14)
2) GB/Europe (Gain min GB=Gain min Europe+3 dB) (FIG. 15)
3) Italy/Europe (Gain min Italy=Gain min Europe+3 dB) (FIG. 16)
4) Spain/Europe (Gain min Spain=Gain min Europe+3 dB) (FIG. 17).

The three feed systems:

Multimode splitter (1 amplifier per channel/beam)

Multimatrix splitter (3 8×8 matrices, 24 amplifiers with optimized phases)

Orthogonal semiactive splitter (4 amplifiers) were calculated by employing the method described above, and the gains obtained are collated in the table below.

| Coverage | Multimode (prior art) Gmin country/ Gmin. EU | Multimatrix (prior art) Gmin country/ Gmin EU | Device according to the invention Gmin country/ Gmin EU |
|---|---|---|---|
| Pan-Eu | - /31.25 dB | - /31.05 dB | - /31.67 dB |
| GB-EU | 33.10 dB/30.10 dB | 33.55 dB/30.55 dB | 34.12 dB/31.12 dB |
| IT-EU | 32.66 dB/29.66 dB | 33.15 dB/30.15 dB | 33.82 dB/30.82 dB |
| SP-EU | 33.28 dB/30.28 dB | 33.02 dB/30.02 dB | 33.77 dB/30.77 dB |

Compared to the multimode system with comparable complexity, the device of the invention affords a gain improvement of 0.42 to 1.16 dB, depending on the beams.

Compared to the multimatrix system with 24 amplifiers, the device according to the invention affords a directionality improvement of 0.62 to 0.75 dB, depending on the beams.

The device of the invention may, if appropriate, be applied:

To transmission, transmission/reception or reception antennas with multiple shaped beams for communications satellites with reconfiguration of traffic and coverage.

To telemetry and telecontrol antennas.

To multicoverage radar antennas.

To antennas for radio beams with angular diversity.

To relay station antennas for mobile telephony.

We claim:

1. A feed device for a multisource semiactive antenna with multiple beams, of the type successively including:

a) a low-level beam shaper device splitting Nb beam input signals as a function of desired coverage characteristics and combining them, after phase shifting, to form Na output signals on its Na outputs, said beam shaper device having a nonorthogonal transfer matrix, b) Na amplifier modules, amplifying, in transmission mode, the Na output signals, c) an output power splitter, arranged between the Na amplifier modules and Ne radiating elements, for receiving Na input signals having Nb distributions with Nb input excitation vectors from said Na amplifier modules and for processing the Na input signals both in power and in phase to produce Ne output signals having Nb distributions with Nb output excitation vectors, said output power splitter being configured such that each of the Ne radiating elements is capable of receiving power from each of the Na input signals, said output power splitter defining an orthogonal transfer matrix wherein $Nb \leqq Na \leqq Ne$, and wherein the orthogonal transfer function of the power splitter is such that said power splitter transforms the Nb distributions at the input of the power splitter, in which the amplitude of the Na input signals is substantially equal for each of the Nb distributions, and in which the phase of the Na input signals satisfies at least the condition of equality of products, taken in pairs, of the Nb excitation vectors at the input of the power splitter, and of scalar products, taken in pairs, of the corresponding Nb excitation vectors at the output of said power splitter, into the Nb distributions at the output of said power splitter.

2. The device as claimed in claim 1, wherein, at the input of the power splitter, the phases of the signals corresponding to one of said Nb distributions is zero.

3. The device as claimed in claim 1, wherein the power splitter includes at least one directional module comprising a directional coupler with two inputs and two outputs and having a given directionality ratio r, and at least one associated phase-shifter element coupled to one output of the directional coupler, the output of said phase shifter constituting a first output of the directional coupler.

4. The device as claimed in claim 3, wherein the power splitter includes [(Ne-1)+(Ne-2)+. . . +(Ne−Na)] directional modules.

5. The device as claimed in claim 1, wherein Nb=Na.

6. The device as claimed in claim 5, wherein Nb=Na=Ne=2, and wherein the power splitter includes a single directional module, comprising one said directional coupler, having a given directionality ratio r, the inputs of which are coupled to the outputs of the amplifier modules, and a phase-shifter element arranged between one output of the directional coupler and one of the two radiating elements, the other output of the directional coupler being directly connected to the other radiating element.

7. The device as claimed in claim 5, wherein Nb=Na=2, and wherein $Ne \geqq 4$, and wherein the directional splitter includes at least five directional modules, each of which includes a directional coupler, having a given directionality ratio r, the inputs of which constitute the inputs of the directional module and which has at a first output a phase-shifter element which is associated with it, the first output of the directional module consisting of the output of the associated phase-shifter element.

8. The device as claimed in claim 7, which includes five directional modules, namely a first directional module having one input connected to the output of a first amplifier module and having its first and second outputs connected to one input, respectively, of a second and of a third directional module, the third directional module also having a second input connected to the output of a second amplifier module, the first and second outputs of the second directional module being connected to a first input, respectively, of a fourth directional module and of a fifth directional module, the first and second outputs of the third directional module being connected to a second input, respectively, of the fifth and of the fourth directional module, and the outputs of the fourth and fifth directional modules each being connected to one radiating element.

9. The device as claimed in claim 8, wherein the directionality ratio r of the first directional coupler of the first directional module and the phase shift of the phase-shifter element which is associated with it are such that, in reception mode, the power at the two input ports of the first directional module is the same for each of the two beams, and wherein the directionality ratio r of the directional couplers of the fourth and fifth directional modules, and the phase shifts of their associated phase-shifter elements are such that the power corresponding to the first beam is concentrated in the reception mode toward a single one of their input ports, and wherein the ratio r of the phase-shifter element of the third directional module and the phase shift of the associated phase-shifter element are such that the power corresponding to the first beam is concentrated toward its second input, and wherein the directionality ratio r of the directional coupler of the first and second directional modules and the phase shifts of their associated phase-shifter elements are such that the output power of the second beam is concentrated, in the reception mode, toward a single one of their input ports.

10. The device as claimed in claim 5, wherein Nb=Na=2, and wherein Ne=8, and wherein the directional splitter includes nine directional modules, each of which has a directional coupler, having a given directionality ratio r, the inputs of which constitute the inputs of the directional module, and having at a first output a phase-shifter element which is associated with it, the output of the associated phase-shifter element constituting the first output of the directional module, a first, second, third and fourth output directional module, having their outputs each connected to one radiating element, an input directional module having its inputs connected to the outputs of amplifier modules, and a first, second, third and fourth intermediate directional module, which are arranged in cascade, the first intermediate directional module having one input coupled to the second output of the input directional module, its first and its second outputs being coupled respectively to one input of the fourth output directional module and to one input of the second intermediate directional module, the second intermediate module having one input coupled to the first output of the input directional module and having its first and its second outputs coupled respectively to one input of the fourth output directional module and to one input of the third intermediate directional module, the third intermediate directional module having its first and second outputs coupled respectively to one input of the fourth intermediate directional module and to one input of the third output directional module, and the fourth intermediate directional module having its first and second outputs coupled respectively to one input of the second and of the first output directional modules.

11. The device as claimed in claim 10, wherein the ratios r of the output couplers and of the second, third and fourth intermediate directional modules, as well as the phase shifts of the phase-shifter elements which are associated with them, are chosen so as to concentrate, in the reception mode, the power corresponding to a directional beam toward a single one of their input ports, while the ratio r of the directional coupler of the first intermediate directional module, and the phase shift of the phase-shifter element which is associated with it, are such that they concentrate, in the reception mode, the power of a nondirectional beam toward a single one of their input ports, and wherein the ratio r of the directional coupler of the input phase-shifter module, and the phase shift of the phase-shifter element which is associated with it, are such that the powers are the same for the two beams at the inputs of the input phase-shifter module, and therefore on the outputs of the two amplifier modules.

12. The device as claimed in claim 3, wherein Nb=2, Na=4 and Ne=4, and which includes a first and a second upstream directional module, the inputs of which are each connected to one output of an amplifier module, as well as a first and a second downstream directional module, the outputs of which are connected to the radiating elements, and wherein the first and the second outputs of the first upstream directional module are connected respectively to one input of the first and of the second downstream directional modules, and wherein the first and the second outputs of the second upstream directional module are connected respectively to one input of the second and of the first downstream directional modules.

13. The device as claimed in claim 12, wherein the ratio r and phase shift of the first and of the second downstream directional modules are such that, in reception mode, the amplitudes of the signals on each of their inputs are equal, for each of the two incident beams, and wherein the ratio r and the phase shift of the first and of the second upstream directional modules are such that in reception mode, the amplitudes of the signals on their inputs are equal, for each of the two incident beams.

14. The device as claimed in claim 1, wherein the output power splitter includes a plurality of phase-shifter modules, including at least one input module, the inputs of which are connected to the outputs of the amplifier modules, and wherein the directionality of the input module or modules is such that, for each beam, the powers on each of the inputs of the input phase-shifter module or modules are the same.

15. The device as claimed in claim 3, wherein the power splitter includes a plurality of directional modules which include a directional coupler having two inputs and two outputs and having, in the case of a directional module of a first type, one phase-shifter element arranged at a single one of the two outputs of said directional coupler, the output of the phase-shifter constituting the output of the module, and, in the case of a directional module of a second type, one phase-shifter element arranged at each of the two outputs of the directional coupler, the outputs of the phase shifters constituting the outputs of the module; and which includes a symmetrical cascade arrangement without crossover, comprising a central line which includes at least one directional module of the second type, this central line being symmetrically surrounded by at least one left line and by at least one right line of directional modules of the first type, which are arranged in cascade without crossover, at least two directional modules of the first type constituting input modules having at least one input constituting the Na inputs of the power splitter, and which has directional modules of the first type constituting output modules and having at least one output connected to one input of the Ne antenna elements.

16. The device as claimed in claim 15, wherein the directional modules of the first type which are arranged on one single side, respectively left or right relative to said central line, have their phase-shifter element arranged in the left or right output, respectively, of their directional coupler.

17. The device as claimed in claim 16, wherein the directional modules of the first type which are neither input modules nor output modules, and which are situated on the left side relative to said central line have at least their right input connected to the left output of an upstream directional module, and vice versa symmetrically for said modules situated on the right side.

18. The device as claimed in claim 17, wherein the directional modules of the first type which are neither input modules nor output modules, and which are situated on an extreme left line relative to said central line, have their left input connected to the left output of an upstream directional module, and their right input connected to the left output of another upstream directional module, and vice versa symmetrically for said modules situated on the right side.

19. The device as claimed in claim 3, wherein at least one phase-shifter element is variable, so as to allow at least partial reconfiguration of the beams.

20. The device as claimed in claim 1, wherein the beam shaper device operates at a frequency which is different than the transmission/reception frequency of the device, and which includes a frequency converter at each of its Na outputs.

21. The device as claimed in claim 1, wherein the beam shaper device operates at the transmission/reception frequency of the device.

22. The device as claimed in claim 1, wherein the beam shaper device is digital and includes digital/analog converters at output.

23. The device as claimed in claim 1, wherein said equality between the amplitudes of the Na signals for each of the Nb beams is produced by tolerating a slight ripple, of the order of ±1 dB, between the Na signals.

24. An antenna which includes a focusing device comprising at least one reflector and/or at least one lens, and a feed device as claimed in claim 1, the Ne radiating elements which are associated with it being positioned relative to the focusing device so as to obtain focusing on transmission and/or on reception.

25. A method for determining the transfer function of an output power splitter of a feed device for a multi-source semiactive antenna with multiple beams, of the type successively including:

a) a low-level beam shaper device splitting Nb beam input signals as a function of desired coverage characteristics and combining them, to form Na output signals of its Na outputs, said beam shaper device having a nonorthogonal transfer matrix, b) Na amplifier modules, amplifying, in transmission mode, the Na output signals, and c) said output power splitter, which is arranged between the Na amplifier modules and Ne radiating elements, for receiving Na input signals having Nb distributions with Nb input excitation vectors from the Na amplifier modules and for providing Ne output signals having Nb distributions with Nb output excitation vectors wherein $Nb \leqq Na \leqq Ne$, the method including the following steps:

setting the amplitudes of the Na input signals to said power splitter to be equal for each of the Nb distributions, determining, based at least in part upon the equal amplitudes of Na input signals for each of the Nb distributions, Nb (Nb-1) equalities of complex scalar products, taken in pairs, of the complex Nb input excitation vectors at the input of the splitter and of the Nb output excitation vectors, determining, based upon the Nb(Nb-1) equalities of the complex scalar products, the phases of the Na input signals, and determining the transfer function of the splitter based in part on the phases of the input signals.

26. The method as claimed in claim 25, wherein, at the input of the power splitter, the phases of the signals corresponding to one of said Nb distributions are zero.

27. The method as claimed in claim 25, wherein the power splitter includes at least one directional module comprising a directional coupler with two inputs and having a given directionality ratio r, and one associated phase-shifter element coupled to one output of the directional coupler.

28. The method as claimed in claim 27, wherein the power splitter includes [(Ne-1)+(Ne-2)+. . . +(Ne−Na)] directional modules.

* * * * *